US010731816B2

(12) United States Patent
Pfaff

(10) Patent No.: US 10,731,816 B2
(45) Date of Patent: Aug. 4, 2020

(54) MOTOR VEHICLE HEADLIGHT MODULE WITH LIGHT DISTRIBUTIONS SPACED FROM THE CUTOFF LINE

(71) Applicant: Automotive Lighting Reutlingen GmbH, Reutlingen (DE)

(72) Inventor: Sebastian Pfaff, Boeblingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 153 days.

(21) Appl. No.: 15/915,502

(22) Filed: Mar. 8, 2018

(65) Prior Publication Data

US 2018/0259147 A1 Sep. 13, 2018

(30) Foreign Application Priority Data

Mar. 9, 2017 (DE) ..... 10 2017 105 027

(51) Int. Cl.
*F21S 41/25* (2018.01)
*F21S 41/143* (2018.01)
(Continued)

(52) U.S. Cl.
CPC ..... *F21S 41/25* (2018.01); *F21S 41/143* (2018.01); *F21S 41/265* (2018.01); *F21S 41/295* (2018.01); *F21S 45/47* (2018.01)

(58) Field of Classification Search
CPC ..... F21S 41/143; F21S 41/147; F21S 41/25; F21S 41/255; F21S 41/26; F21S 41/265; F21S 41/27; F21S 41/275; F21S 41/295
See application file for complete search history.

(56) References Cited

U.S. PATENT DOCUMENTS 5,302,778 A * 4/1994 Maurinus ..... H01L 25/167 174/521
6,416,210 B1 * 7/2002 Uchida ..... F21S 41/255 362/539
(Continued)

FOREIGN PATENT DOCUMENTS

EP 1447617 A2 8/2004
EP 2280214 A1 2/2011
(Continued)

OTHER PUBLICATIONS

Office Communication for European Application No. 18156868.4 dated May 28, 2018.
(Continued)

*Primary Examiner* — Matthew J. Peerce
*Assistant Examiner* — Steven Y Horikoshi
(74) *Attorney, Agent, or Firm* — Howard & Howard Attorneys PLLC

(57) ABSTRACT

A motor vehicle headlight module has a semiconductor light source and a projection lens, which generates a light distribution in which an edge of the semiconductor light source is projected as a light/dark boundary, wherein the projection lens has a first subsection that generates a first subsidiary light distribution, and a second subsection that generates a second subsidiary light distribution, which is superimposed on the first subsidiary light distribution. The projection lens has a third subsection, which generates a third subsidiary light distribution, which is delimited by the light/dark boundary, and which overlaps the first subsidiary light distribution and the second subsidiary light distribution, wherein the first subsidiary light distribution and the second subsidiary light distribution lie below the light/dark boundary generated by the third subsection.

12 Claims, 4 Drawing Sheets

(51) Int. Cl.

| | |
|---|---|
| ***F21S 41/265*** | (2018.01) |
| ***F21S 41/29*** | (2018.01) |
| *F21S 45/47* | (2018.01) |

(56) References Cited

U.S. PATENT DOCUMENTS

| | | | | |
|---|---|---|---|---|
| 7,648,262 | B2 | 1/2010 | Tanaka | |
| 9,033,563 | B1 | 5/2015 | Hsu | |
| 2011/0096561 | A1 | 4/2011 | Owada | |
| 2013/0250599 | A1* | 9/2013 | Owada | F21S 41/192<br>362/520 |
| 2016/0201868 | A1* | 7/2016 | Hayashi | F21S 41/143<br>362/520 |

FOREIGN PATENT DOCUMENTS

| | | | |
|---|---|---|---|
| EP | 2610547 | A2 | 7/2013 |
| EP | 2924339 | A1 | 9/2015 |
| EP | 3043109 | A1 | 7/2016 |
| FR | 3022980 | A1 | 1/2016 |
| JP | 2015158986 | A | 9/2015 |
| WO | 2014077079 | A1 | 5/2014 |

OTHER PUBLICATIONS

Examination Report for German Patent Application No. 10 2017 105 027.2 dated Nov. 14, 2017.

* cited by examiner

MOTOR VEHICLE HEADLIGHT MODULE WITH LIGHT DISTRIBUTIONS SPACED FROM THE CUTOFF LINE

CROSS-REFERENCE TO RELATED APPLICATIONS

The present application claims priority to and all the benefits of German Patent Application No. 10 2017 105 027.2, filed on Mar. 9, 2017, which is hereby expressly incorporated herein by reference in its entirety.

BACKGROUND OF THE INVENTION

1. Field of the Invention

The invention relates to a motor vehicle headlight module.

2. Description of the Related Art

Such a light module is known from EP 3 043 109 A1. The known light module has a semiconductor light source and a projection lens, which is disposed in a light beam originating from the semiconductor light source and generates a light distribution from the light beam, in which an edge of a light emission surface of the semiconductor light source is projected as a light/dark boundary. The projection lens has a first subsection that generates a first subsidiary light distribution, and a second subsection that generates a second subsidiary light distribution, which is superimposed on the first subsidiary light distribution. The first subsection is delimited by a pronounced bend in the light entry surface of the projection lens.

The known light module is an example of a direct imaging light module. Such light modules enable generation of light distributions with a minimal number of components. A direct imaging system is normally composed of one or more light sources and a single projection optical element, normally a projection lens.

The generation of a light/dark boundary with a direct imaging system is known, for example, from EP 1 447 617 A2. The lower edge of an LED row is projected therein as a light/dark boundary. Moreover, the use of a segmented lens is known from the U.S. Pat. No. 7,648,262 B2 for optimizing the light distribution. The optimized light distribution in this patent corresponds to an asymmetrical low beam light. A segmenting of the lens surface is not used for color correction. A direct imaging light module is also known from EP 2 924 339 A1. In both EP 2 924 339 A1 and EP 3 043 109 A1, subsidiary light distributions are generated with different subsections of the projection lens, which have a color fringe at their edges. The disruptive color fringe is eliminated by an appropriate superimposing of a reddish color fringe of the subsidiary light distribution on a bluish color fringe of another subsidiary light distribution.

Light modules are also known that generate a light/dark boundary by projecting light over a shutter disposed in the beam path.

SUMMARY OF THE INVENTION

The object of the invention is to create an inexpensive and efficient motor vehicle headlight module that generates a light distribution with a light/dark boundary.

The present invention differs from the prior art specified in the introduction in that the projection lens has a third subsection lying between the first subsection and the second subsection, which generates a third subsidiary light distribution that is delimited toward the top by the light/dark boundary generated as a projection of the edge of the semiconductor light source and overlaps the second subsidiary light distribution of the motor vehicle headlight module, wherein the first subsidiary light distribution and the second subsidiary light distribution lie below a line that lies below the light/dark boundary generated by the middle subsection in the motor vehicle headlight module, and has a spacing to this light/dark boundary ranging from 0.5° to 2°. Position indications such as below or above always relate in this application to a position obtained in an intended use of the motor vehicle headlight module.

A light distribution in which a color fringe is compensated for with a greater vertical width and a higher contrast light/dark boundary is obtained by these features with a simply structured direct imaging system. The invention is based on the knowledge that a subsidiary light distribution with a higher contrast light/dark boundary and without a disruptive color fringe can already be generated with just the middle subsection. This light distribution has the property that it has only a limited width in the direction transverse to the light/dark boundary, which is a vertical direction in an intended use of the light module. This has advantages regarding the brightness at the light/dark boundary, but the area in front of the light module lying between the light/dark boundary and the vehicle in which the light module is installed remains insufficiently lit. This disadvantage is eliminated by the other two subsidiary light distributions, which are generated with subsections of the projection lens lying at a greater distance from the center of the lens, and which are superimposed in order to illuminate the area toward the front. Furthermore, these subsidiary light distributions increase the brightness in the lateral regions and in the core of the overall light distribution obtained by the overlapping. Color fringes occurring at the edges of these subsidiary light distributions are compensated for thereby, in that a bluish color fringe is superimposed on a reddish color fringe, such that on the whole, thus also including the contribution of the white subsidiary light distribution of the middle subsection, a color-neutral light distribution is obtained. Most importantly, the subsidiary light distributions of the two subsections of the projection lens lying further from the middle of the lens are overlapped by the white (i.e. without any, or at least without a pronounced, color fringe) subsidiary light distribution of the central subsection.

The light module according to the invention is suitable in particular for use as a turning light module and/or a static cornering light module, or as an ambient light module.

The light module according to the invention generates the light/dark boundary from the projection optical element itself through an appropriate shaping of the lens surface. In comparison with systems that have a shutter, the number of necessary components is reduced. The implementation of the color correction through segmentation of the lens results in an additional cost advantage over known systems.

One design is distinguished in that the first subsection and the second subsection lie on different sides of an optical axis of the projection lens.

In one embodiment, the first subsection lies above the optical axis and the second subsection lies below the optical axis in an intended use of the light module.

In one embodiment, the center of the third subsection lies on the optical axis.

It is furthermore preferred that the three subsidiary light distributions have the same horizontal width in an intended use of the light module.

In one embodiment, the first subsidiary light distribution and the second subsidiary light distribution are wider than the third subsidiary light distribution over the vertical axis in an intended use of the light module.

One embodiment is distinguished in that the projection lens is smooth in the regions of its optical surfaces, and not stepped.

In one embodiment, a light entry surface of the projection lens facing the semiconductor light source is divided horizontally into three subsurfaces, which transition into one another without steps or bends. The lens may also be integrated in a frame serving as a lens mount.

One embodiment is distinguished in that the lens and the frame are made of the same material.

In one embodiment, an end of the frame facing away from the lens in the direction of the optical axis is configured for attaching a circuit board with the semiconductor light source, and a cooling element.

In one embodiment, the frame has form-fitting structures that establish, together with the complementary form-fitting structures of the circuit board and/or the cooling element, the position of the semiconductor light source in relation to the projection lens along the optical axis and transverse to the optical axis.

One embodiment is distinguished in that the semiconductor light source has a least two adjacent light emission surfaces, adjacent to one another in a direction transverse to the optical axis, and delimited along this direction by edges that are flush to one another.

Further advantages can be derived from the dependent claims, the description, and the attached drawings.

As a matter of course, the features specified above and still to be explained below can be used not only in the respective given combinations, but also in other combinations or in and of themselves, without abandoning the scope of the present invention.

BRIEF DESCRIPTION OF THE DRAWINGS

Exemplary embodiments of the invention are illustrated in the drawings, and shall be explained in greater detail in the following description. Identical reference symbols refer to identical or at least comparable elements with regard to their function in the various figures. Therein, schematically in each case.

DETAILED DESCRIPTION OF THE INVENTION

Figure 1:
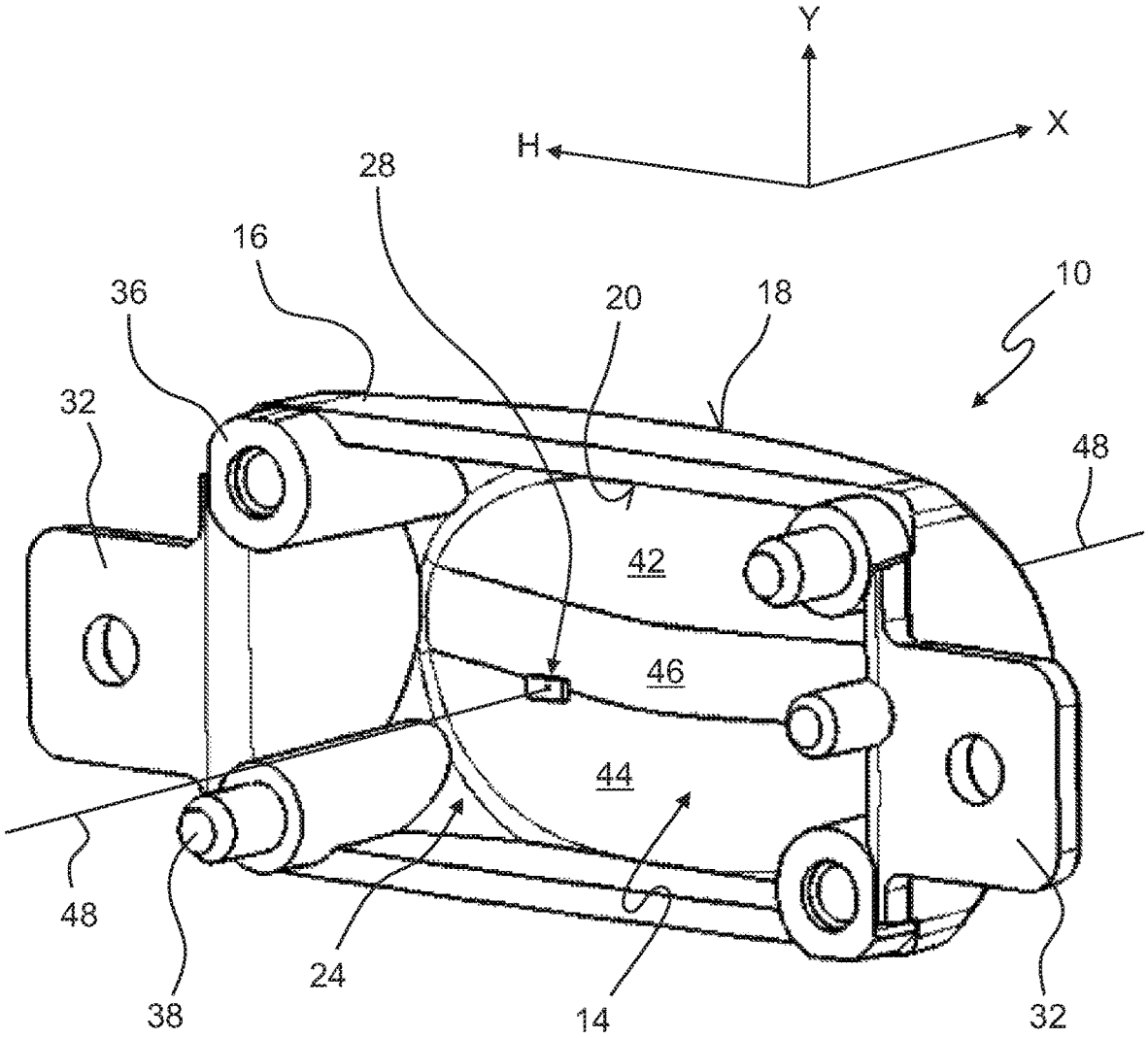
FIG. 1 shows a perspective view of a base element of an exemplary embodiment of a light module according to the invention.
Figure 2:
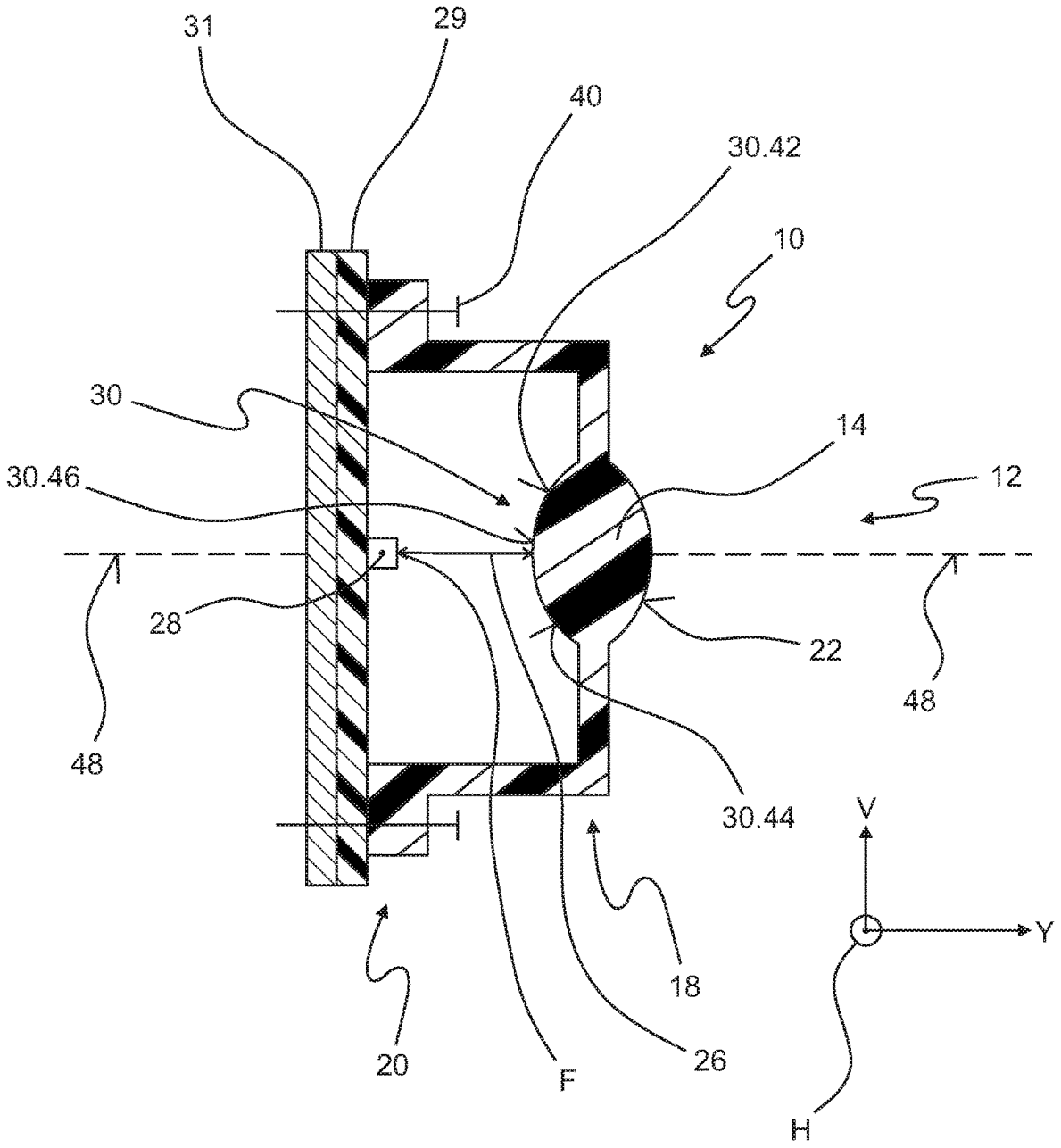
FIG. 2 shows, schematically, a vertical section through an exemplary embodiment of a light module according to the invention, with a base element according to FIG. 1.

In the following description of individual figures, clearly visible features in other figures shall be referenced without explicit reference to the respective other figure. FIG. 1 shows a perspective rear view of a base element 10 of an exemplary embodiment of a motor vehicle headlight module 12 according to the invention, as it is illustrated in FIG. 2 in a vertical section. The x-axis represents the main beam direction of the light module 12. The H-axis represents the direction perpendicular to the horizontal direction of travel in the intended use, and V-axis represents the vertical direction. The base element 10 is composed of a single piece, and preferably of a uniform material. The material is preferably a transparent plastic such as PVC or PMMA.

The base element 10 has a projection lens 14 and frame 16 formed as material-bonded part of the projection lens 14. The frame 16 has a first end 18 and a second end 20. The first end 18 is the part of the frame 16 transitioning in a material-bonded manner into the projection lens 14. The frame 16 extends from this first end 18 into the half-space facing away from a light emission surface 22 (cf. FIG. 2) of the projection lens 14 to the second end 20. The base element 10 can be closed in the region of the frame 16 surrounding the optical axis, but for thermal reasons, is preferably provided with openings toward the top and bottom.

The oval optical surface of the projection lens 14 here is extended in the depicted exemplary embodiment to form a rounded rectangular outer shape of the frame 16. The optical surface can also be rounded, e.g. circular. The resulting, non-optical, region 24 of the frame 16 fills in the intermediate space between the optical lens surface and the frame 16. The semiconductor light source 28 is attached to a circuit board 29. The circuit board 29 is in thermal contact with a cooling plate 31, which is screwed to the base element 14 with screws 34. The rectangular outer shape of the frame 16 formed by the extension also serves, through the eyelets formed therein, as a fastening element between the projection lens 14, the circuit board 29 and the cooling plate 31. The cooling element is an example of an advantageously simple and inexpensive cooling element. If desired, a more complex cooling element can also be used, exhibiting cooling ribs or cooling pins.

Form-fitting structures are disposed at the second end. In the depicted version, the form-fitting structures are first bearing surfaces 36 and reference pins 38. The circuit board 29 and/or a cooling plate 31 supporting the circuit board 29 (cf. FIG. 2) also have complementary form-fitting structures, i.e. holes for the reference pins 38 and second bearing surfaces that bear on the first bearing surfaces 36 of the base element 10. A precisely defined spacing 26 to the projection lens 14 and semiconductor light source 28 is obtained through the bearing surfaces with only minimal bearing tolerances. The height positioning precision of the semiconductor light source 28 required by the limited focal length of the projection lens 14 necessary for high efficiency and a short structural length is enabled in the framework of the present invention by the minimal number of components used. Moreover, savings in costs for materials and installation are obtained through the low number of parts.

Figure 3:
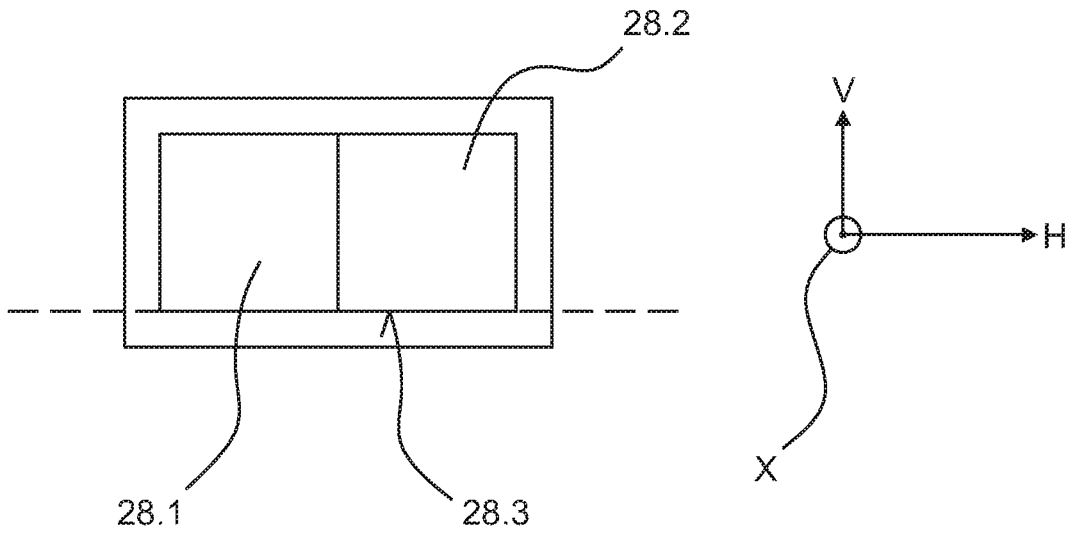
FIG. 3 shows a top view of an example of a semiconductor light source.

FIG. 3 shows a top view of an example of a semiconductor light source 28. The depicted semiconductor light source 28 is a horizontal double chip. For use in motor vehicle headlights, the edges of the individual chips 28.1, 28.2 are 0.3 mm to 1.5 mm, for example. The chips initially emit blue light, which is converted to white light using a yellow fluorescent coating applied to the chips that has blue and yellow-red spectral components. The heat released in this semiconductor light source 28 is discharged by the inexpensive cooling plate 31 from FIG. 2, which has no cooling ribs. Cooling elements that do have cooling ribs can, however, also be used instead of the cooling plate 31.

A focal point F of the projection lens 14 is preferably located in the light emission surface of the semiconductor light source 28. A horizontal edge 28.3 of the light emission surfaces of the semiconductor light source is then projected as the light/dark boundary. The horizontal edge 28.3 is obtained in that the light emission surfaces of the semiconductor light source are delimited by edges lying adjacent to one another in a horizontal direction transverse to the optical axis, and flush in this direction.

The circuit board 29, or the cooling plate 31 supporting the circuit board 29, is oriented during assembly by the interaction of the form-fitting elements in relation to the projection lens 14, and securely connected to the frame 16 of the base element 10 by additional attachment mechanisms, such as screws 40, for example, which are screwed from the light emission side through holes in the frame 16 of the base element 10 into the cooling plate 31 bearing on the bearing surfaces or on the circuit board 29. The cooling plate 31 preferably also serves in this context as a cutting material for the screws 40 holding the individual cooling plate 31, circuit board 29 and base element 10 together. The attachment can optionally take place through suitable pressure springs, such that it is possible to adjust and lock the components in place during the assembly thereof. The attachment can also be obtained without screws through clips, clamps or other known technologies.

As a result, a semiconductor light source 28 of the light module 12 is retained in its correct position in relation to the projection lens 14. FIG. 1 shows such a semiconductor light source 28 in such a position, without a circuit board and without a cooling plate.

A shutter (not shown) can be attached to the cooling plate 31 or the frame 16, which extends into the light beam between the light emission surfaces of the semiconductor light source 28 and the projection lens 14, and delimits it such that, optionally, only the light entry surface of the projection lens 28 is lit, or such that no disrupting light reflections are generated by uncontrolled light propagation outside the actual projection lens 14.

Alternatively, or additionally, the base element 10 forming a combined lens mount and projection lens can be coated with an absorbing material or tinted for this purpose in certain regions. As a result, the external appearance of the active, refractive lens surface can be stylistically highlighted.

The preferably oval inner lens surface can transition directly into a correspondingly curved frame 16 of the base element 10, or it can be extended, as shown in FIG. 1, to form another shape, e.g. a rounded rectangular, contoured overall surface. The resulting, optically inactive region 24 in the corners of the surface no longer contribute to the light distribution, but may potentially allow small amounts of light to pass through, in order to form the night design of the light module 12. Alternatively, the optically inactive regions 24 may be opaque. This can be obtained in the production of the base element 10 by a two-component injection molding process. The light entry surface 30 of the projection lens 14 may transition abruptly to the optically inactive regions 24 at a sharp edge. Preferably, however, the light entry surface 30 of the projection lens 14 transitions to the optically inactive regions 24 with a smooth curved transition surface, in order to provide the outer design with a continuous surface, without edges.

The projection lens 14 is disposed in a light beam emitted by the semiconductor light source. Both the light entry surface 30 as well as the light emission surface 22 of the projection lens 14 are smooth, without steps in or between their active refractive subsections. The light entry surface 30 of the projection lens facing the semiconductor light source 28 is subdivided horizontally into three regions, which transition smoothly into one another (i.e. without steps and without any significant bends), and which serve in part for the shaping of the light/dark boundary, and in part for an optimization of the light distribution, in particular with respect to a desired color neutrality (without color fringes). The projection lens has a first subsection 42, a second subsection 44, and a third subsection 46 lying between the first subsection 42 and the second subsection 44. The first subsection 42 and the second subsection 44 lie on different sides of an optical axis 48 of the projection lens 14. With an intended use of the light module 12, one of the two subsections 42, 44 lies above the optical axis 48, and the other of the two subsections 42, 44 lies below the optical axis 48. The center of the third subsection 46 is preferably on the optical axis 48. The center is the focal point of the surface of the third subsection 46 projected in a plane running along the optical axis 48.

The subdivision of the projection lens 14 into these subsections takes place through the aforementioned subdivision of the light entry surface 30 of the projection lens 14 facing the semiconductor light source 28 into three subsidiary surfaces disposed successively in the vertical direction and which transition into one another without steps and without a significant bend, such that a smooth light entry surface is obtained on the whole.

Figure 4:
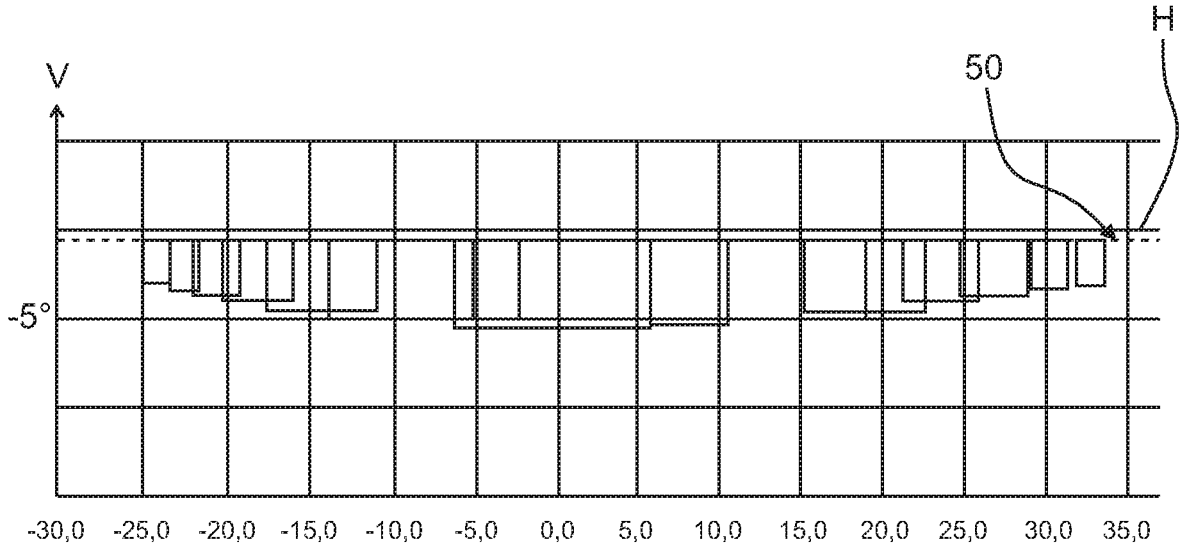
FIG. 4 shows spiral image illustrations of the central subsection of the projection lens.

FIG. 4 shows a so-called spiral image depiction of the central, third subsection 46 of the projection lens 14. In the spiral image depiction, the third subsection 46 is divided conceptually, or in a simulation, into numerous horizontal adjacent lens segments, and the edges of the images that provide each individual segment of the light emission surface of the semiconductor light source 28 are shown. FIG. 4 illustrates an ensemble of such spiral images.

As can be seen in FIG. 4, the upper edges of the spiral images are very close to one another in the vertical direction, such that a sharp and straight light/dark boundary 50 is obtained on the whole, which is obtained collectively from the direct imaging of the lower edge 28.3 of the light emission surface of the double chip of the semiconductor light source 28. Because the spiral images of a lens become more tightly curved further away from the center of the lens in the vertical direction, the light/dark boundary is generated in the present invention by the third subsection 46 of the projection lens 14 lying in the middle of the lens.

This is accompanied by the further advantage that the spiral images are brightest there, thus making it possible to obtain a good contrast in the light/dark boundary 50. Furthermore, the light experiences hardly any vertical dispersion due to a comparatively slight lens curvature of the projection lens 14, resulting in a light/dark boundary with a minimal color fringe. The light distribution generated only by the third subsection 46 is very narrow in the vertical direction, and limited to the region between the light/dark boundary 50 lying about 0.6° below the level of the horizon H, and about 5° below the horizon H. This is not sufficient for lighting the area in front of the vehicle. In order to generate a homogenous illumination in front of the vehicle, or to the side thereof in the case of a cornering lights, the area below V=−5° must also be lit. If all of the spiral images were positioned directly on the light/dark boundary 50, the area in front of the vehicle would be dark. In order to also evenly light this front area, there is the possibility of reducing the focal length of the projection lens, thus enlarging the spiral images. This is not feasible in the production thereof, however, due to tolerance requirements.

In order to be able to nevertheless light the front area, the spiral images must be lowered. Consequently, because the spiral images of the third subsection 46 must generate the light/dark boundary at basically the level of the horizon H, the curved spiral images from the upper (first) subsection 42 and the lower (second) subsection 44 must be lowered through a corresponding shape of the first subsidiary surface 30.42 and the second subsidiary surface 30.44 of the light entry surface 24 of the projection lens 14. This takes place, i.e. all of the surfaces are oriented, such that all of the spiral images of the first subsection 42 and the second subsection 44 remain below a line 50' that is parallel to the light/dark boundary 50, which is lowered at least 0.5°, but no more than 2°. The first subsidiary light distribution 52 and the second subsidiary light distribution 54 thus lie below a line 50', which lies below the light/dark boundary 50 generated by the third subsection 56 in an intended use of the motor vehicle headlight module 12, at a spacing of at least 0.5° and no more than 2° to the first light/dark boundary 50. The first subsection 42 and the second subsection 44 of the projection lens 15, or the respective associated subsidiary surfaces 30.42 ad 30.44 of the light entry surface 30 of the projection lens 14 are tightly curved, resulting in a color fringe of the respective associated spiral image.

The upper edge of the spiral images from the upper (first) subsection 42 of the projection lens 15 has a reddish color fringe, and the lower edge has a spectrally complementary bluish color fringe. This is reversed for the lower (second) subsection 44 of the projection lens 14. To correct these color effects, the spiral images from the upper (first) subsection 42 of the projection lens 14 are superimposed on the spiral images from the lower (second) subsection 44. This is obtained through the regional modification of the shape of the first subsidiary surface 30.42 and the second subsidiary surface 30.44 of the light entry surface 30 of the projection lens. The complementary color fringes thus result in color neutrality through color mixing. Moreover, the overlapping region of the two subsidiary light distributions 52, 54 of the regions 52 and 44 lying closer to the light/dark boundary 50 falls in the white region of the subsidiary light distribution 56 generated by the middle subsidiary region 46. As a result, any color fringe there is outshined and thus less noticeable.

The finished lens entry surface 30 of the projection lens 14 is thus composed of three subsidiary surfaces: a middle (third) subsidiary surface 30.46, which generates the light/dark boundary, and is color neutral, and an upper (first) subsidiary surface 30.42 and a lower (second) subsidiary surface 30.44, which collectively light the front area, in that they lower the continuous light beams somewhat in relation to the continuous light beams of the middle (third) subsidiary surface 30.46 (in a downward direction), and superimpose these at the same time, such that a color neutrality is obtained.

The three subsidiary surfaces 30.42, 30.44, and 30.46 of the light entry surface 30 of the projection lens 14 and thus also the associated subsections 42, 44, and 46 of the projection lens 14, have substantially the same lateral spread width as the respective associated light distribution. The convex curvature of the light emission surface 22 of the projection lens 14 is established before the fine correction of the light entry surface 30, which has a substantially aspherical, curved shape.

Figure 5:
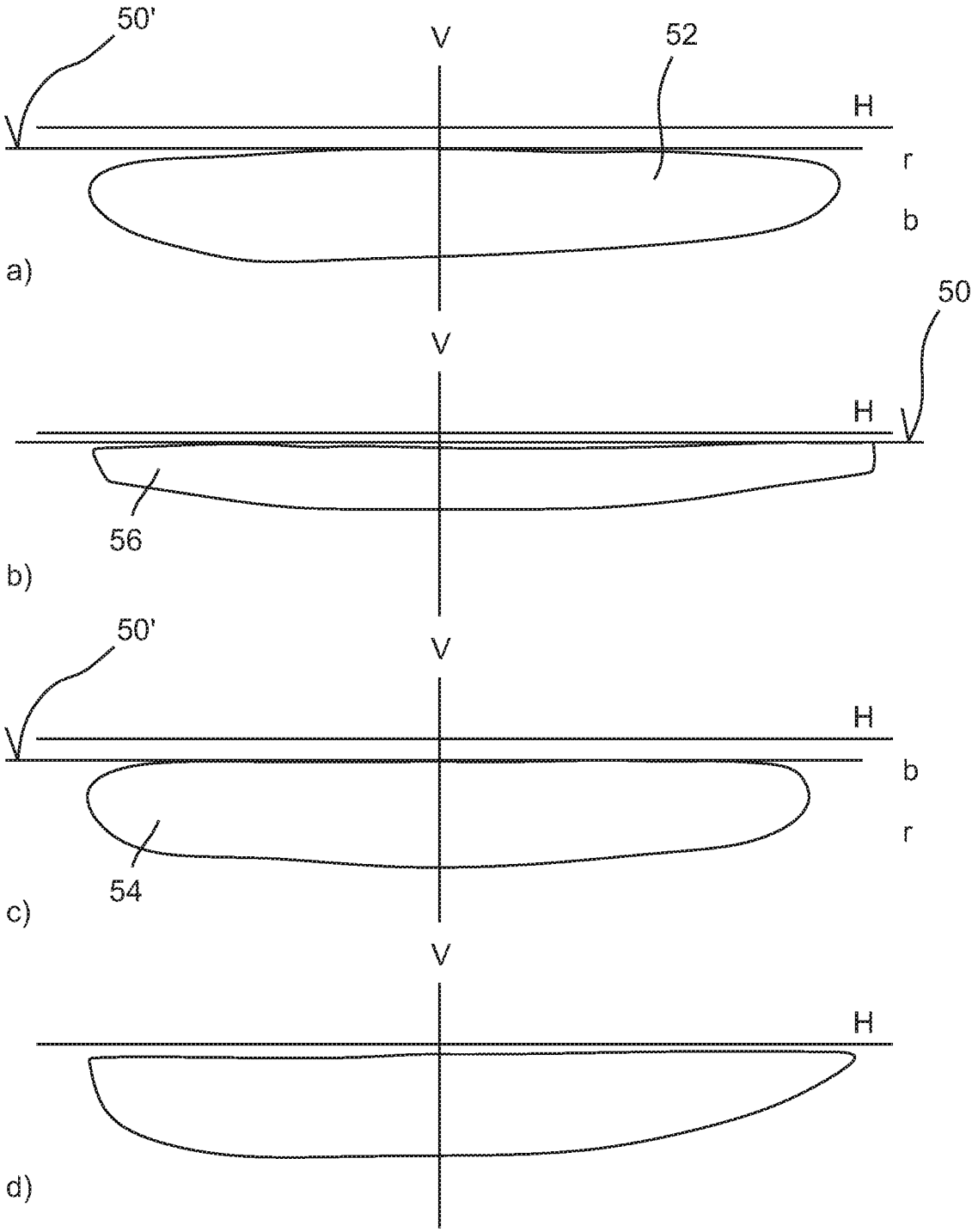
FIG. 5 shows various subsidiary light distributions and the superimposing thereof to form an overall light distribution of a light module according to the invention.

FIG. 5 shows the different subsidiary light distributions and the superimposing thereof to form an overall light distribution. FIG. 5*a* shows the first subsidiary light distribution 52 generated by the first subsection 42, and FIG. 5*c* shows the second subsidiary light distribution 54 generated by the second subsection 44. Both light distributions have a nearly identical shape, and differ in terms of the positions of their upper and lower color fringes, indicated by an r for a reddish color fringe, and a b for a bluish color fringe.

FIG. 5*b* shows the vertically narrower third subsidiary light distribution 56 generated by the third subsection 46, which has a sharp light/dark boundary 50, and is already color neutral. The subsidiary light distributions 52, 54, and 56 have the same width in the horizontal direction H in an intended use of the light module. The first subsidiary light distribution 52 and the second subsidiary light distribution 54 are wider than the third subsidiary light distribution 56 in the vertical direction. These two subsidiary light distributions 52, 54 lie below a line 50', which lies below the light/dark boundary 50 generated by the third subsection 46 in an intended use of the motor vehicle headlight module 12, and is at a spacing of at least 0.5° and no more than 2° to the first light/dark boundary (50). The angles relate to angles of the light beams emitted by the motor vehicle headlight module according to the invention in relation to a screen that is perpendicular to the optical axis, which is perpendicular to the horizon and through which the optical axis passes. FIG. 5*d* shows the resulting overlapping of the subsidiary light distributions 52, 54, and 56. The result of this overlapping has a sharp light/dark boundary 50, is color neutral, and is sufficiently wide in the vertical direction to brightly light the area in front. The imagings relate to an exemplary embodiment with a straight light/dark boundary, as is typical for a cornering light.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A motor vehicle headlight module including a semiconductor light source and a projection lens, which is disposed in a light beam emitted by the semiconductor light source, and which generates a light distribution from the light beam in which an edge of a light emission surface of the semiconductor light source is projected as a light/dark boundary;

the projection lens has a first subsection that generates a first subsidiary light distribution, and a second subsection that generates a second subsidiary light distribution, which is superimposed on the first subsidiary light distribution, wherein the projection lens has a third subsection lying between the first subsection and the second subsection, which generates a third subsidiary light distribution, which is delimited at the top in an intended use of the motor vehicle headlight module by the light/dark boundary generated as a projection of the edge of the semiconductor light source, and which overlaps the first subsidiary light distribution and the second subsidiary light distribution, wherein the first subsidiary light distribution and the second subsidiary light distribution lie below a line, which lies below the light/dark boundary generated by the third subsection in an intended use of the motor vehicle headlight module, and is at a spacing to the light/dark boundary of at least 0.5° and no more than 2°; and wherein a light entry surface of the projection lens facing the semiconductor light source is divided horizontally into a middle third subsidiary surface which generates the light/dark boundary, and is color neutral, and an upper first subsidiary surface and a lower second subsidiary surface which collectively light the front below the light/dark boundary, the three subsidiary surfaces of the light entry surface of the projection lens are associated with the subsections of the projection lens and three subsidiary surfaces transition into one another without steps and without a noticeable bend.

2. The motor vehicle headlight module as set forth in claim 1, wherein the first subsection and the second subsection lie on different sides of an optical axis of the projection lens.

3. The motor vehicle headlight module as set forth in claim 2, wherein the first subsection lies above the optical axis and the second subsection lies below the optical axis in an intended use of the light module.

4. The motor vehicle headlight module as set forth in claim 3, wherein the center of the third subsection lies on the optical axis.

5. The motor vehicle headlight module as set forth in claim 1, wherein the three subsidiary light distributions are of the same width in the horizontal direction in an intended use of the light module.

6. The motor vehicle headlight module as set forth in claim 1, wherein the first subsidiary light distribution and the second subsidiary light distribution are wider than the third subsidiary light distribution in the vertical direction in an intended use of the light module.

7. The motor vehicle headlight module as set forth in claim 1, wherein the projection lens is smooth in the region of its optical surface, and not stepped.

8. The motor vehicle headlight module as set forth in claim 1, wherein the projection lens is integrated in a frame serving as a lens mount.

9. The motor vehicle headlight module as set forth in claim 8, wherein the projection lens and the frame are made of the same material.

10. The motor vehicle headlight module as set forth in claim 8, wherein an end of the frame facing away from the projection lens in the direction of the optical axis is configured for attaching a circuit board with the semiconductor light source, and a cooling plate thereto.

11. The motor vehicle headlight module as set forth in claim 8, wherein the frame has form-fitting structures that establish the position of the semiconductor light source in relation to the projection lens along the optical axis and transverse to the optical axis.

12. The motor vehicle headlight module as set forth in claim 1, wherein the semiconductor light source has at least two adjacent light emission surfaces, which are adjacent to one another transverse to the optical axis, and are delimited in this direction by edges that are flush to one another.

* * * * *